US006133933A

United States Patent [19]

Paoli

[11] Patent Number: 6,133,933

[45] **Date of Patent: *Oct. 17, 2000**

[54] COLOR XEROGRAPHIC PRINTING SYSTEM WITH MULTICOLOR PRINTBAR

[75] Inventor: Thomas L. Paoli, Los Altos, Calif.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/782,158

[22] Filed: Jan. 13, 1997

[51] Int. Cl.[7] ..... B41J 2/45

[52] U.S. Cl. ..... 347/238; 347/232

[58] Field of Search ..... 347/119, 237, 347/240, 238, 232, 225, 118, 134; 428/690; 411/120; 313/503; 358/300; 257/79, 89, 98; 430/45

[56] References Cited

U.S. PATENT DOCUMENTS

| | | | |
|---|---|---|---|
| 3,013,890 | 12/1961 | Bixby | 430/45 |
| 3,854,070 | 12/1974 | Vlasenko et al. | 313/503 |
| 4,078,929 | 3/1978 | Gundlach | 347/119 |
| 4,807,047 | 2/1989 | Sato et al. | 358/300 |
| 4,855,760 | 8/1989 | Kanayama | 347/240 |
| 5,337,074 | 8/1994 | Thornton | 347/237 |
| 5,347,303 | 9/1994 | Kovacs et al. | 347/134 |
| 5,373,313 | 12/1994 | Kovacs | 347/119 |
| 5,402,436 | 3/1995 | Paoli | 347/238 |
| 5,444,463 | 8/1995 | Kovacs et al. | 347/118 |
| 5,674,635 | 10/1997 | Hsieh et al. | 428/690 |
| 5,855,994 | 1/1999 | Paoli | 428/209 |

FOREIGN PATENT DOCUMENTS

| | | | |
|---|---|---|---|
| 2-245733 | 10/1990 | Japan | 411/120 |

OTHER PUBLICATIONS

T. Tsutsui et al.; "Electroluminescence in organic thin films," *Photochemical Processes in Organized Molecular Systems*, edited by K. Honda pp. 437–450 (1991).

J. Kido et al.; "White light–emitting organic electroluminescent devices using the poly(N–vinylcarbazole) emitter layer doped with three fluorescent dyes", *Appl. Phys. Lett.*, vol. 64, pp. 815–817 (1994).

J. Kido et al.; "Multilayer White Light–Emitting Organic Electroluminescent Device", *Science*, vol. 267, pp. 1332–1334 (1995).

A. Dodabalapur et al.; "Micro cavity effects in organic semiconductors," *Appl. PHys. Lett.*, vol. 64, pp. 2486–2488 (1994).

H. A. Macleod; Chapter 1 of *Applied Optics and Optical Engineering*, vol. X, edited by R.R. Shannon and J.C. Wyant, 1987.

P.E. Burrows et al. "Color–tunable organic light–emitting devices," *Appl. Phys. Lett.*, vol. 69, pp. 2959–2961 (1996).

*Primary Examiner*—N. Le
*Assistant Examiner*—Lamson D. Nguyen
*Attorney, Agent, or Firm*—Oliff & Berridge, PLC

[57] ABSTRACT

An electrostatographic development system includes a multicolor array; a photoreceptor having a plurality of layers, each layer being sensitive or accessible only to one of multiple wavelengths; and electrostatographic development apparatus for exposing areas of the photoreceptor to emitted light from the multicolor printbar, and, after exposure, depositing at least a plurality of toners on the photoreceptor in response to exposure of areas of layers of the photoreceptor to the emitted light. The multicolor array for such an electrostatographic development system includes a plurality of subarrays of light emitting areas arranged across a length of the array, wherein each of the plurality of subarrays includes a plurality of light emitting areas and each of the plurality of subarrays emit light of a different wavelength from the remaining subarrays.

21 Claims, 3 Drawing Sheets

COLOR XEROGRAPHIC PRINTING SYSTEM WITH MULTICOLOR PRINTBAR

BACKGROUND OF THE INVENTION

This invention relates to a color Xerographic printing system having a multicolor printbar rather than a traditional polygon ROS (raster output scanning) system. More particularly, the present invention relates to a color Xerographic printing system having a polychromatic photoreceptor and a multicolor printbar for developing a full color image on the photoreceptor.

Generally, the process of Xerographic (electrostatographic) printing includes the step of charging an imaging member to a substantially uniform potential to sensitize the surface thereof. The charged portion of the surface is exposed to an image, such as an image of an original document being reproduced, or to a computer-generated image written by a raster output scanner. This records an electrostatic latent image on the imaging member corresponding to the original document or computer-generated image. The recorded latent image is then developed by bringing a developer material into contact therewith. In a tri-level system, three separate potential levels are used. The unexposed areas of the latent image are developed in one color, and the fully discharged areas are developed in another color; the partially exposed areas remain undeveloped. This forms a toner powder image on the imaging member that is subsequently transferred to a substrate, such as paper. Finally, the toner powder image is permanently affixed to the substrate in image configuration, for example by heating and/or pressing the toner powder image.

A suitable developer material may be a two-component mixture of carrier particles having toner particles triboelectrically adhered thereto. The toner particles are attracted to and adhere to the electrostatic latent image to form a toner powder image on the imaging member surface. Suitable single component developers are also known. Single component developers comprise only toner particles; the particles have an electrostatic charge (for example, a triboelectric charge) so that they will be attracted to, and adhere to, the latent image on the imaging member surface.

Various forms of systems for producing two-color developed images are also known. For example, U.S. Pat. No. 4,078,929 to Gundlach teaches the use of a tri-level electrostatographic system as a means to achieve singlepass highlight color images. Gundlach teaches a method for two-color development of an electrostatic charge pattern of a single polarity and having three different levels of potential by utilizing relatively negatively charged toner particles of one color and relatively positively charged toner particles of a second color. In this method, the photoreceptor is initially charged to a voltage $V_0$. It is then selectively discharged with a single raster output scanner to approximately $V_0/2$ in the background areas and to near 0 or residual potential in the color areas. The fully discharged areas are printed in color, and the unexposed areas, which undergo dark discharge, are printed in black (or a second color). Alternatively, the colors may be reversed, i.e., the unexposed areas may be developed in color, and the areas of near 0 or residual potential may be developed in black (or a different color).

Another method of two-color reproduction is disclosed in U.S. Pat. No. 3,013,890 to Bixby. Bixby teaches a method in which a charge pattern of either a positive or negative polarity is developed by a single, two-color developer. The developer of Bixby comprises a single carrier that supports both triboelectrically relatively positive and relatively negative toner. The positive toner is a first color and the negative toner is a second color. The method of Bixby develops positively charged image areas with the negative toner and develops negatively charged image areas with the positive toner. A two-color image occurs only when the charge pattern includes both positive and negative polarities.

However, these development systems do not provide multicolor or full spectrum print results, desirable in many applications. These development systems rely upon a photoreceptor, charged to different charge amounts by a single charging means.

Various forms of development systems for producing multicolor developed images are also known. For example, U.S. Pat. No. 5,347,303 to Kovacs et al. discloses a full color xerographic printing system, in either single or double pass operation, using a single polygon ROS containing a dual wavelength diode laser. The system further includes a dual layer photoreceptor wherein each photoreceptor layer is sensitive to or accessible by only one of the two wavelengths of the diode laser.

U.S. Pat. No. 5,373,313 to Kovacs discloses a full color xerographic printing system, in single pass operation, using a single polygon ROS containing a multiple wavelength diode laser. The system further includes a multiple layer photoreceptor wherein each photoreceptor layer is sensitive to or accessible by only one of the multiple wavelengths of the diode laser.

U.S. Pat. No. 5,444,463 to Kovacs et al. discloses a single pass three-toner color xerographic development system. The development system uses a two-layer photoreceptor and a single polygon ROS system having a dual wavelength diode laser array. Each of the two photoreceptor layers is sensitive to or accessible by only one of the dual wavelengths of the diode laser.

There remains a need in the art for multicolor printing systems that can operate at higher speeds, but also at a lower cost. However, production of such systems has heretofore been hindered by the difficulty in manufacturing the necessary multicolor laser diode array. For example, due to absorption spectra of polychromatic photoreceptors for the development of four colors, the multiple wavelengths need to be separated by a large amount, typically 100 nm or more. Thus a multicolor system would be expected to require wavelengths of in the blue (400 to 500 nm), green (500 to 600 nm), red (600 to 700 nm) and infrared (700 to 800 nm) regions. However, the attainment of four wavelengths over such a wide range is very difficult in a monolithic diode laser structure, because it requires the integration of at least two different material systems. In addition, printing at high speed requires an addressable array at each color, making the array even more complex and expensive to fabricate. Nonmonolithic assemblies of addressable arrays are another possible approach to fabricating such a monolithic laser array source, but such assemblies are not straightforward and have not yet been demonstrated.

Therefore, there remains a need in the electrostatographic printing art for a full color printing system that does not require the complex ROS and multiple wavelength laser systems. In particular, there is a need for a less complex and less costly system for high speed multicolor printing.

SUMMARY OF THE INVENTION

These and other problems of the prior art are overcome by the apparatus and processes of the present invention.

The present invention provides a multicolor light emitting array, comprising a plurality of subarrays of light emitting areas arranged across a length of said multicolor array, wherein each of said plurality of subarrays comprises a plurality of said light emitting areas and each of said plurality of subarrays emit light of a different wavelength from a remainder of said arrays.

The present invention also provides an electrostatographic development system comprising:

a multicolor array as described above, a photoreceptor means having a plurality of layers, each layer being sensitive or accessible only to one of said wavelengths, and electrostatographic development means for exposing areas of said photoreceptor means to emitted light from said multicolor array, and, after exposure, said development means depositing at least a plurality of toners on said photoreceptor means in response to exposure of said areas of said layers to said emitted light.

The electrostatographic printing system of the present invention thereby provides a printing system suitable for high speed, multicolor printing operations, but at a lower cost and decreased complexity from the polygon ROS systems with multiple wavelength diode laser arrays of the prior art.

DETAILED DESCRIPTION OF PREFERRED EMBODIMENTS

Figure 1:
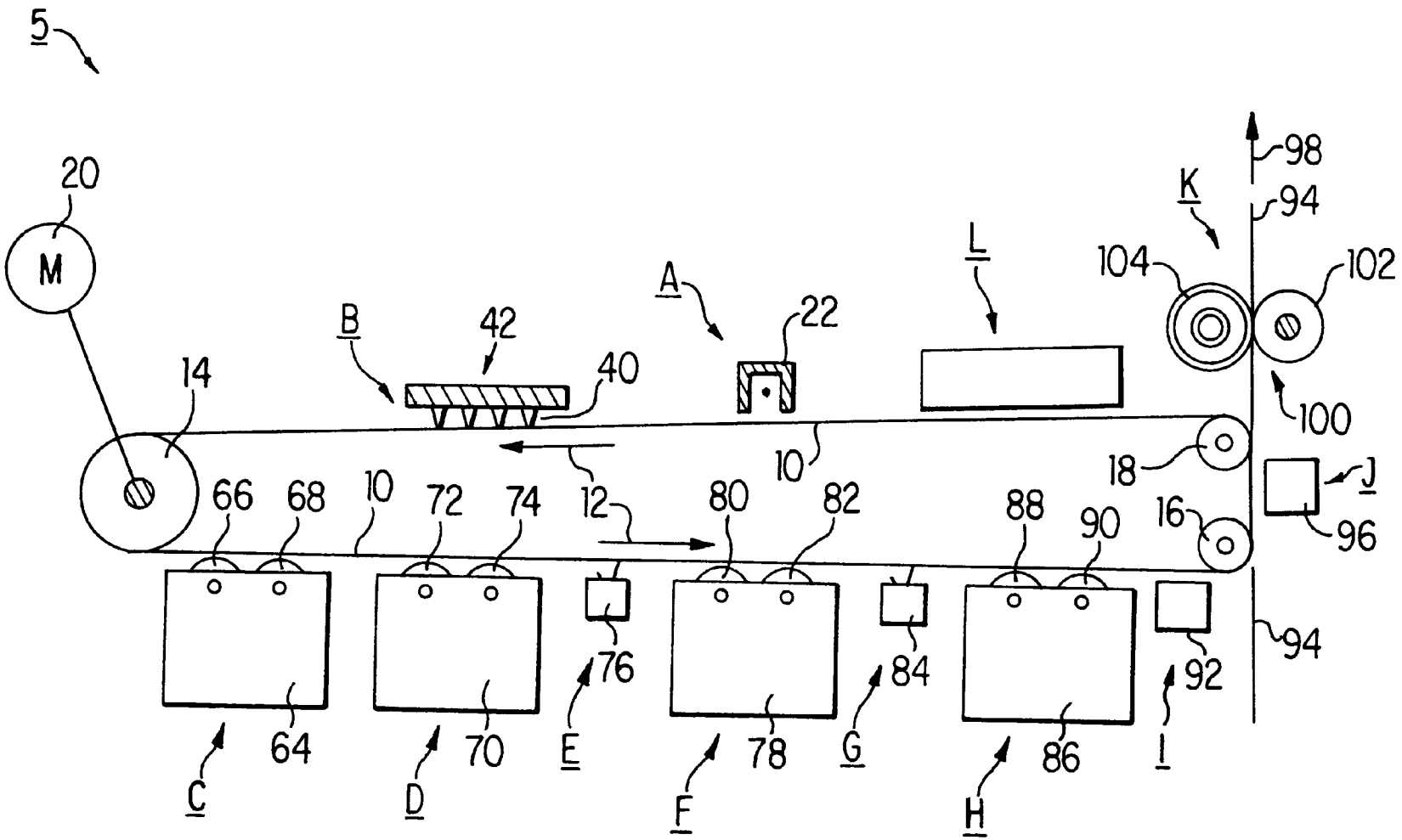
FIG. 1 is a schematic diagram depicting an illustrative electrostatographic printing system according to the present invention.

The present invention is generally directed to an electrostatographic printing system in which a multicolor printbar, preferably a full-width printbar, is used to image a polychromatic photoreceptor. With the printing system of the present invention, full color images can be formed at high speed, at lower cost, and with less complexity than in printing systems using a raster output scanning system with a polygonal mirror and a multicolor diode laser array.

The printing system of the present invention, in one embodiment, comprises substituting a multicolor printbar for a multicolor laser source polygon ROS in a conventional multicolor printing system. Such a system incorporates a polychromatic photoreceptor, which is imaged by the multicolor printbar to provide the multicolor electrostatic latent image on the photoreceptor surface. For example, such a polygon ROS system is disclosed in U.S. Pat. Nos. 5,373,313, 5,347,303 and 5,444,463, the entire disclosures of which are incorporated herein by reference.

In embodiments of the present invention, the multicolor printbar generally comprises a plurality of linear arrays of light emitting areas extending along the length of the printbar. Each light emitting area within each of the plurality of linear arrays preferably emits at substantially the same wavelength to provide uniform exposure of the photoreceptor. Furthermore, each of the plurality of linear arrays is preferably selected to provide a sufficient wavelength spacing between the emissions of the arrays, thereby to provide a match to the absorption spectrum of the photoreceptor. Furthermore, each of the respective emitting areas of each of the plurality of linear arrays are preferably aligned such that each emitting area from each of the linear arrays sequentially exposes a line of spots on the photoreceptor as it advances in the slow-scan direction.

More particularly, in embodiments of the present invention, the multicolor printbar is used to image four different colors onto the photoreceptor. In this embodiment, the printbar includes four linear arrays of light emitting areas. The linear arrays are provided so as to emit multiple wavelengths, separated by a sufficiently large amount to match the absorption spectrum of the photoreceptor. For example, it is preferred that the wavelength separation be between 50 and 150 nm, more preferably about 100 nm. In embodiments, the respective linear arrays emit at wavelengths in the blue (400 to 500 nm), green (500 to 600 nm), red (600 to 700 nm) and infrared (700 to 800 nm) regions. For example, emissions from the respective arrays at about 450 nm, 550 nm, 650 nm, and 750 nm provide adequate matching to polychromatic photoreceptors. However, the present invention is not limited to embodiments imaging four different colors onto a photoreceptor, and more or less colors can be imaged by modifying the multicolor printbars disclosed herein.

Figure 2:
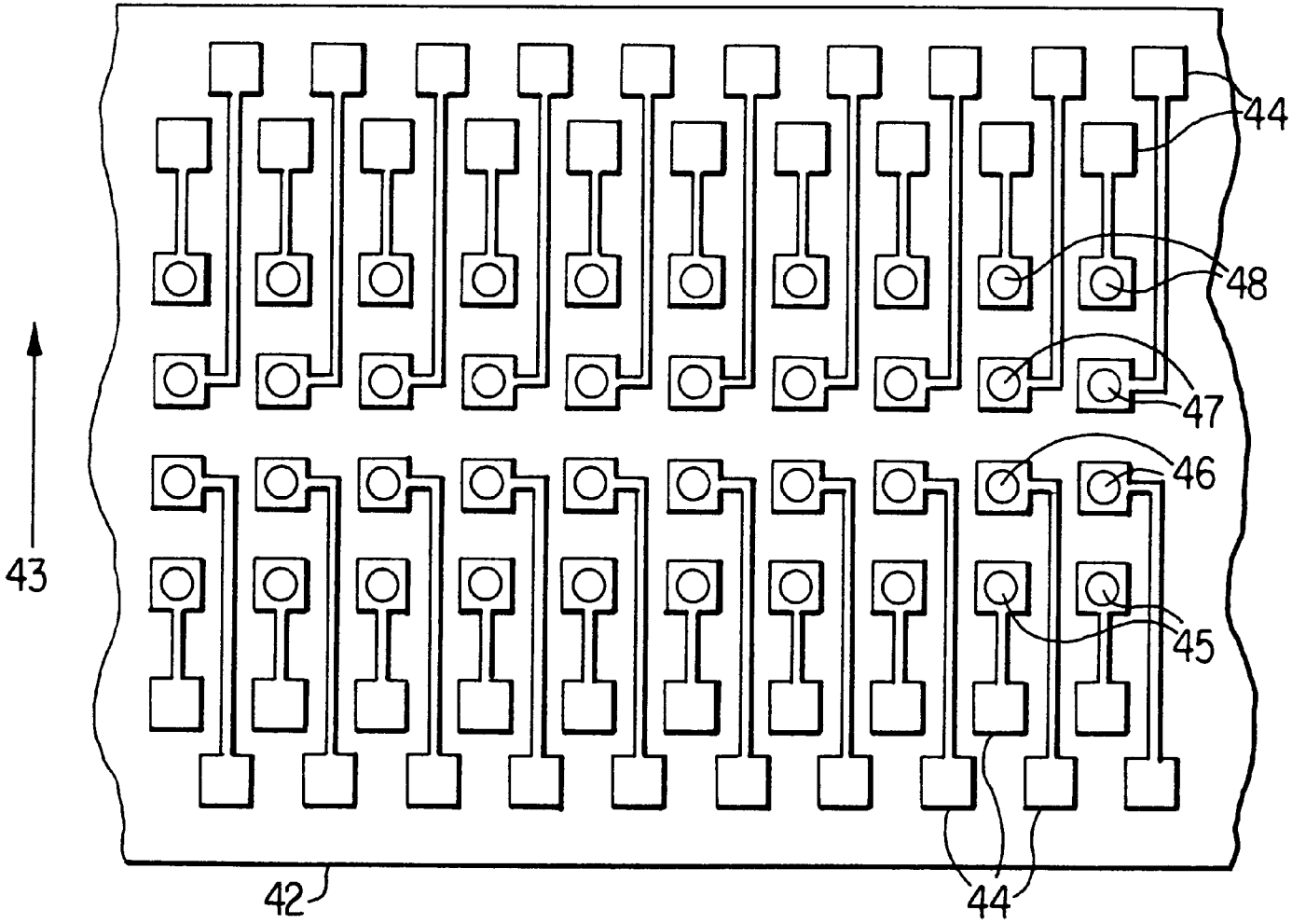
FIG. 2 is a schematic diagram depicting a fullwidth multicolor printbar according to an embodiment of the present invention.

An example of such a full-width multicolor printbar according to an embodiment of the present invention is schematically depicted in FIG. 2. In FIG. 2, the printbar 42 comprises four linear arrays of light emitting areas 45, 46, 47 and 48. In the depicted printbar, the light emitting areas on the printbar emit blue light from the light emitting areas 48, green light from the light emitting areas 47, red light from the light emitting areas 46, and infrared light from the light emitting areas 45 as the printbar moves in the slow-scan direction indicated generally by arrow 43. The printbar also includes suitable electrical contacts 44 for coupling each of the light emitting areas to a suitable control means. As shown in FIG. 2, each of the sets of light emitting areas 45, 46, 47 and 48 are arranged in a linear manner on the printbar, and the individual light emitting areas in all of the sets are arranged in a linear manner in the slow-scan direction 43, so that a single spot on a photoreceptor can be imaged by all four colors if desired.

Preferably, in embodiments of the present invention, the printbar is a full-width printbar. That is, the printbar with the arrays of light emitting areas extends the full width of the print area of the photoreceptor, so that the entire width of the photoreceptor can be imaged in a single operation by the printbar. Alternatively, however, one or more partial width printbars can be used in embodiments to image the full width of the photoreceptor. If such partial width print bars are utilized, the manufacturing and arrangement of the printbars is essentially the same as that described above.

In embodiments of the present invention, the light emitting areas can be fabricated by any suitable means, so long as the light emitting areas can be accurately spaced and located in the printbar, and their emission characteristics can be accurately set. For example, suitable light emitting areas can include, but are not limited to, electroluminescent devices, vertical cavity surface emitting lasers, light emitting diodes, and the like.

Electroluminescent devices and their construction are generally known in the art. See, for example "Electroluminescence in organic thin films", by T. Tsutsui, C. Adachi, and S. Saito, in *Photochemical Processes in Organized Molecular Systems*, edited by K. Honda, pp 437–450 Elsevier Science Publishers B. V. (1991), the entire disclosure of which is incorporated herein by reference. Such electroluminescent devices generally comprise an electroluminescent organic and/or polymeric material, doped with one or more dyes to provide the desired emittance wavelength(s). For example, J. Kido et al., "White light-emitting organic electroluminescent devices using the poly(N-vinylcarbazole) emitter layer doped with three fluorescent dyes," *Appl. Phys. Lett.*, Vol. 64, pp. 815–817 (1994), the entire disclosure of which is incorporated herein by reference, discloses such an electroluminescent device. In the disclosed device of Kido, an electroluminescent poly(N-vinylcarbazole) emitter layer is doped with three different dues, to emit light in the red, green, and yellow-green wavelengths.

In embodiments of the present invention, the electroluminescent device can be fabricated similar to the device disclosed in Kido, except that four dyes are incorporated into the electroluminescent poly(N-vinylcarbazole) emitter layer to provide emittance in the blue, green, red, and infrared wavelength regions, corresponding to wavelengths appropriate for use with a polychromatic photoreceptor. The color of respective light emitting areas of the electroluminescent device forming the multicolor printbar can be chosen by fabricating the emitters into Fabry-Perot cavities resonant at the appropriate wavelength, as described below. Furthermore, the relative intensity of each transmitted color can be controlled by controlling the concentration of the corresponding dye in the electroluminescent emitter layer.

In other embodiments of the present invention, the electroluminescent device for use in the multicolor printbar can be formed using multiple electroluminescent emitting layers, rather than a single layer doped with four dyes. For example, the electroluminescent device can be fabricated to have as many as four (or more) electroluminescent emitting layers, each doped with an appropriate respective dye. The use of multiple emitting layers is described, for example, in J. Kido, et. al., "Multilayer White Light-Emitting Organic Electroluminescent Device," *Science*, Vol. 267, pp. 1332–1334 (1995), the entire disclosure of which is incorporated herein by reference. Unlike the device of Kido, which contains three emitting layers, however, the electroluminescent devices used in the present invention include four emitting layers. For example, the electroluminescent device according to the present invention could include a third electron-transporting layer, doped with an appropriate dye, to provide the device with three electron-transporting emitter layers and one hole-transporting emitter layer.

Alternatively, the fourth emitter layer can be added to the electroluminescent device in the form of a further hole-transporting emitter layer, doped with an appropriate dye for the desired wavelength transmittance. This embodiment would thus provide an electroluminescent device with two electron-transporting emitter layers and two hole-transporting emitter layers.

As with the single emitter layer device described above, the multi-layer device can be tuned to achieve specific desired results depending on the application. The color of the respective light emitting areas of the electroluminescent device forming the multicolor printbar can be chosen by fabricating the emitters into Fabry-Perot cavities resonant at the appropriate wavelength as described below. The relative intensity of each transmitted color can be controlled by controlling the concentration of the corresponding dye in the respective electroluminescent emitter layers. The intensity can also be controlled by controlling the thickness of the hole blocking layer interposed between the electron transporting layers and the hole transporting layers, as well as by controlling the thickness of the respective emitting layers.

Furthermore, the present invention is not limited to embodiments having either one or four emitter layers in the electroluminescent device. Rather, the electroluminescent device used to form the multicolor printbar can take any of various forms that will be apparent based on the present disclosure. For example, the electroluminescent device can be formed using the same three-layer device disclosed in Kido, but adding a suitable dopant dye to the hole transporting layer to provide emissions of a desired wavelength. Other alternatives are also available, and are encompassed by the present invention.

In forming the electroluminescent devices, it is necessary that the color of each emitting spot be specifically chosen to emit at the desired wavelength. The difficulty with this selection is that electroluminescent materials typically have a broad spectral line width, of as much as 100 nm or more. However, in embodiments of the present invention, the spectral emission may be narrowed to the desired target wavelength by fabricating the emitters into Fabry-Perot cavities resonant at the appropriate wavelength.

One approach that may be used in embodiments for narrowing and tuning the spectral wavelength is to use a spacer layer within the cavity to set the optical length of the cavity for resonance at a single wavelength. Such an approach is described in A. Dodabalapour et. al., "Microcavity effects in organic semiconductors," *Appl. Phys. Lett.*, Vol. 64, pp. 2486–2488 (1994), the entire disclosure of which is incorporated herein by reference.

However, in preferred embodiments of the present invention, the spectral characteristics are adjusted by spatially tuning the mirror in each cavity, rather than varying the cavity's optical length. This approach avoids the problem that the wide spread between the shortest and longest wavelengths in a single printbar impedes making each cavity resonant at only one wavelength. Thus, in preferred embodiments of the present invention, the resonant wavelength of a cavity is controlled by varying the coating at each emitter to create high reflectivity at the wavelength of the desired emitted light. Accordingly, the electroluminescent device of the present invention in these embodiments use a different quarter wave stack for each of the different emitted light wavelengths such that the stack's reflectivity is high only for a narrow range of wavelengths centered on the particular desired color.

As a further alternative, the spectral characteristics of the various emissive spots of the electroluminescent device can be selected by using different coatings on the different wavelength areas. For example, the shortest wavelength emitters can use a coating having a high pass characteristic, whereby only the shortest wavelength is reflected, and the longest wavelength emitters can use a coating having a low pass characteristic, whereby only the longest wavelength is reflected. This approach may be preferred in embodiments because it somewhat relaxes the spectral demands on the coating characteristics. In addition, these high-pass and low-pass coatings can be selected such that each of the coatings reflect pairs of the shortest and longest wavelengths, respectively, with the desired color within each pair for a particular emitter being selected by varying the optical cavity length, as described above. Examples of such suitable materials include, but are not limited to, alternating $\lambda/4$ stack of $Al_2O_3$, $MgO_2$, $TiO_2$, $SiO_2$, or $ZrO_2$, as well known to those skilled in the art.

In forming the electroluminescent device, the various coatings and layers are applied by conventional processing. Furthermore, the characteristics of each coating are defined by appropriate photolithographic, masking, and coating sequences. The thin film coatings may be constructed and deposited by techniques that are well-known to those skilled in art, e.g. as described by H. A. Macleod, in Chapter 1 of Applied Optics and Optical Engineering, Vol X, edited by R. R. Shannon and J. C. Wyant, the entire disclosure of which is incorporated herein by reference.

In embodiments of the present invention, emitted light can be extracted from either side of the electroluminescent device, depending upon specific application requirements. If light is to be extracted from the substrate side, then the coating must be sufficiently transmissive at each wavelength to permit sufficient light to be emitted. If light is to be extracted from the other side, then the metal contacts must be partially transmissive, while the coating is highly reflective, to permit sufficient light to be emitted. Once emitted, the light can be directed onto the photoreceptor with either conventional microlenses or with lenses formed directly on the glass substrate.

The electroluminescent devices may be formed into a monolithic printbar as follows. A thin film reflector for each color is first formed on the glass substrate by depositing a stack of alternating quarter-wave layers of suitable dielectric materials as well-known in the art. The reflector for each color is patterned into narrow strips that extend the length of the printbar. A filler material, such as polyimide or other suitable insulator, is placed between the strips of reflectors to make the top surface approximately planar. An electrical contact layer, such as indium tin oxide, and the multiple layers of organic materials are then sequentially deposited over the surface. After the final organic layer has been deposited, the top contact, e.g. Mg:Ag, is simultaneously deposited and patterned above each row of reflectors to define individual electroluminescent devices emitting at each color and aligned down the length of the printbar. After completion of the top contact, individual multicolor printbars are cut out of the large substrate.

In the above discussion, the electroluminescent device used to form the multicolor printbar is discussed as being formed of a single monolithic unit, generally having four emitting arrays of a length sufficient to form a full-width printbar. However, in embodiments, modifications of this design are possible and may be preferred. For example, in one embodiment, a four-color printbar may be made by assembling two monolithic chips, each having two linear arrays emitting at two different wavelengths as taught in U.S. patent application Ser. No. 08/577,794 Entitled "Color Xerographic Printer with Multiple Linear Arrays of Surface Emitting with Dissimilar Wavelengths", filed Dec. 22, 1995. Similarly, the printbar can be made by assembling four separate chips, each having a single linear array emitting at a different wavelength from the other arrays. Furthermore, the printbar can be either a single full-width printbar or an assembly of shorter width printbars, as described above. Alternatively, in embodiments, a single printbar of shorter than full-width can be used in conjunction with projection magnification to expose the full width of the photoreceptor, as taught in U.S. Pat. No. 5,337,074, the entire disclosure of which is incorporated herein by reference.

Furthermore, the above discussion has focused upon the use of a multicolor printbar that emits light at four different wavelengths to expose a polychromatic photoreceptor. However, multicolor (e.g., four color) printing can also be conducted using light emissions of only two wavelengths. For example, U.S. Pat. No. 5,347,303 to Kovacs et al., the entire disclosure of which is incorporated herein by reference, discloses a full color xerographic printing system, in either single or double pass operation, using a single polygon ROS containing a dual wavelength diode laser. The system further includes a dual layer photoreceptor wherein each photoreceptor layer is sensitive to or accessible by only one of the two wavelengths of the diode laser. This same approach can be used in embodiments of the present invention, wherein the single polygon ROS containing a dual wavelength diode laser is replaced by a multicolor printbar emitting light at two wavelengths. In this embodiment, the printbar may be made from two linear arrays of electroluminescent devices emitting two different wavelengths, as described above.

The present invention, however, is not limited to the use of electroluminescent devices in the multicolor printbar. Rather, the multicolor printbar can be formed in any fashion such that it emits multiple light wavelengths of sufficient characteristics to expose a polychromatic photoreceptor.

For example, the printbar can also be fabricated using current light emitting diode (LED) technology, extended according to the principles of the present invention to provide the desired multicolor printbar. For example, in embodiments, subarrays of multiple LED emitter chips emitting at different wavelengths may be mechanically assembled into a single full-width array including multiple parallel linear arrays emitting at different wavelengths. Although it is preferred that such an assembly include a printbar emitting only two different wavelengths, such as to expose a two-layer photoreceptor, the printbar is not limited thereto, and may be fabricated to emit at more than two wavelengths, or may emit at different wavelengths and different polarizations.

In a further embodiment of the present invention, the light emitting areas of the multicolor printbar may be formed by monolithically forming vertical cavity surface emitting lasers emitting at different wavelengths into parallel linear arrays. In embodiments, the parallel linear arrays may be either full-width, or may be shorter than full-width and optionally combined with projection magnification to expose the full width of the photoreceptor, as disclosed in U.S. Pat. No. 5,337,074. The parallel arrays may also optionally emit at different orthogonal polarizations, depending on requirements of specific applications.

In yet further embodiments, the various above embodiments may be combined into a single multicolor printbar. That is, the multicolor printbar may be fabricated to include any combination of electroluminescent devices, light emitting diodes, and vertical cavity surface emitting lasers to provide the desired wavelength emissions.

Of course, as will be apparent to one of ordinary skill in the art based on the present disclosure, the multicolor printbars encompassed by the present invention are not limited to the specifics described above. For example, numerous of the parameters, such as emission wavelengths, light emitting area alignment, wavelength separation, and the like, can be altered and varied to suit specific applications.

In the printing systems according to the present invention, the multicolor printbar is used to expose a polychromatic photoreceptor. Although the specifics of the photoreceptor are not particularly important, it is necessary that the particular photoreceptor used in particular embodiments be sufficiently designed that the photoreceptor is properly exposed by the multicolor printbar, and provide good copy quality. Such photoreceptors are generally known in the art, and their construction will be apparent to one of ordinary skill in the art based on the present disclosure. For example, a suitable four-layer photoreceptor is described in U.S. Pat. No. 5,373,313, the entire disclosure of which is incorporated herein by reference.

Furthermore, in embodiments described above, it is possible in embodiments to use a dual-layer photoreceptor in conjunction with the dual-color printbar to obtain full color printing. Such dual-layer photoreceptors are also generally known to one of ordinary skill in the art based on the present disclosure. For example, a suitable two-layer photoreceptor is described in U.S. Pat. No. 5,347,303, the entire disclosure of which is incorporated herein by reference.

The present invention also encompasses a method of generating images with the multicolor printbars disclosed herein. The method generally comprises the steps of generating an electrostatic latent image on a photoreceptor, developing the latent image with a toner comprised of resin, pigment such as carbon black or other colored dye, and a charge additive, and transferring the developed electrostatic image to a substrate. Optionally, the transferred image can be permanently affixed to the substrate. Development of the image may be achieved by a number of known development methods, such as cascade, touchdown, powder cloud, magnetic brush, and the like. Transfer of the developed image to a substrate may be by any suitable method, including those making use of a corotron or a biased roll. The fixing step may be performed by means of any suitable method, such as flash fusing, heat fusing, pressure fusing, vapor fusing, and the like. Any material generally used in electrostatographic copiers and printers may be used as a substrate, such as paper, transparency material, or the like. Modification of these development processes will also be apparent to one skilled in the art.

The invention will now be described in detail with reference to specific preferred embodiments thereof. All parts and percentages are by weight unless otherwise indicated.

EXAMPLES

Example 1

An electroluminescent device for use in a multicolor printbar according to the present invention is produced to emit light at four different wavelengths, in the blue, green, red, and infrared regions.

Figure 3:
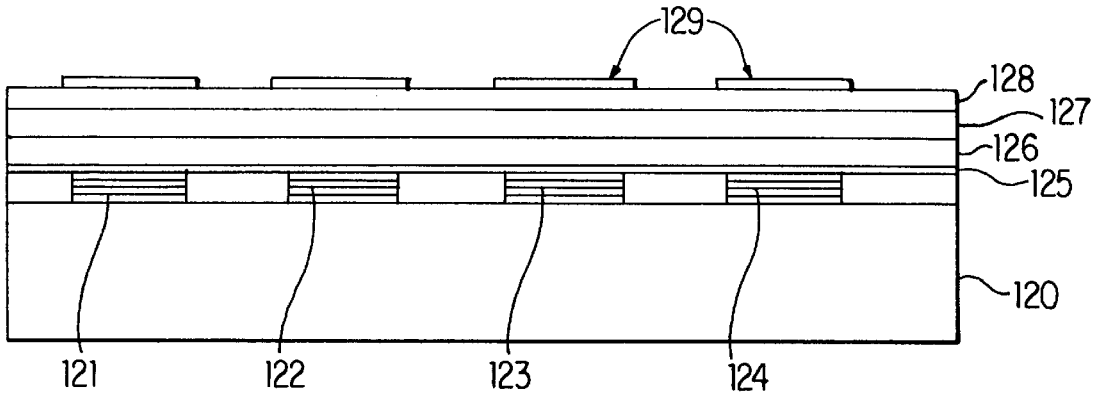
FIG. 3 is a schematic diagram of a multi-layer electroluminescent device used for a multicolor printbar according to an embodiment of the present invention.

Following the procedure described in J. Kido et al., "White light-emitting organic electroluminescent devices using the poly(N-vinylcarbazole) emitter layer doped with three fluorescent dyes," *Appl. Phys. Lett.*, Vol. 64, pp. 815–817 (1994), a multi-layer electroluminescent device is produced. The structure of the electroluminescent device is shown schematically in FIG. 3. As shown in FIG. 3, the device includes a glass substrate 120, reflectors 121, 122, 123, and 124, an indium tin oxide contact layer 125, an emitter layer 126, a hole blocking/electron transport layer 127, an electron transporting layer 128, and magnesium:silver contacts 129. In the electroluminescent device of this Example, the emitter layer is formed of poly(N-vinylcarbazole) doped with four dyes; the hole blocking/electron transport layer is formed of 3-(4'-tert-butylphenyl)-4-phenyl-5-(4"biphenyl)-1,2,4-triazole; and the electron transporting layer is formed of tris(8-quinolinolato) aluminum(III). The reflectors 121, 122, 123 and 124 are produced to reflect infrared, red, green and blue light wavelengths, respectively.

The dyes used to make a four color printbar are, for example, 1,1,4,4-tetraphenyl-1,3-butadiene for the blue at 450 nm, coumarin 6 for the green at 510 nm or DCM 1 for the green at 550 nm, sulforhodamine 101 for the red, and 5,10,15,20-tetraphenyl-21H,23H-porphine for the red at 655 nm and/or infra-red at 725 nm. This latter dye is described, for example, in P. E. Burrows et al., "Color-tunable organic light-emitting devices," *Appl. Phys. Lett.*, Vol. 69, pp. 2959–2961 (1996).

The electroluminescent devices are formed into a monolithic printbar as follows. A thin film reflector for each color is first formed on the glass substrate by depositing a stack of alternating quarter-wave layers of suitable dielectric materials as well-known in the art. The reflector for each color is patterned into narrow strips that extend the length of the printbar. A filler material, such as polyimide or other suitable insulator, is placed between the strips of reflectors to make the top surface approximately planar. An electrical contact layer, such as indium tin oxide, and the multiple layers of organic materials are then sequentially deposited over the surface. After the final organic layer has been deposited, the top contact, e.g. Mg:Ag, is simultaneously deposited and patterned above each row of reflectors to define individual electroluminescent devices emitting at each color and aligned down the length of the printbar. After completion of the top contact, individual multicolor printbars are cut out of the large substrate.

Example 2

An electroluminescent device for use in a multicolor printbar according to the present invention is produced to emit light at four different wavelengths, in the blue, green, red, and infrared regions.

Figure 4:
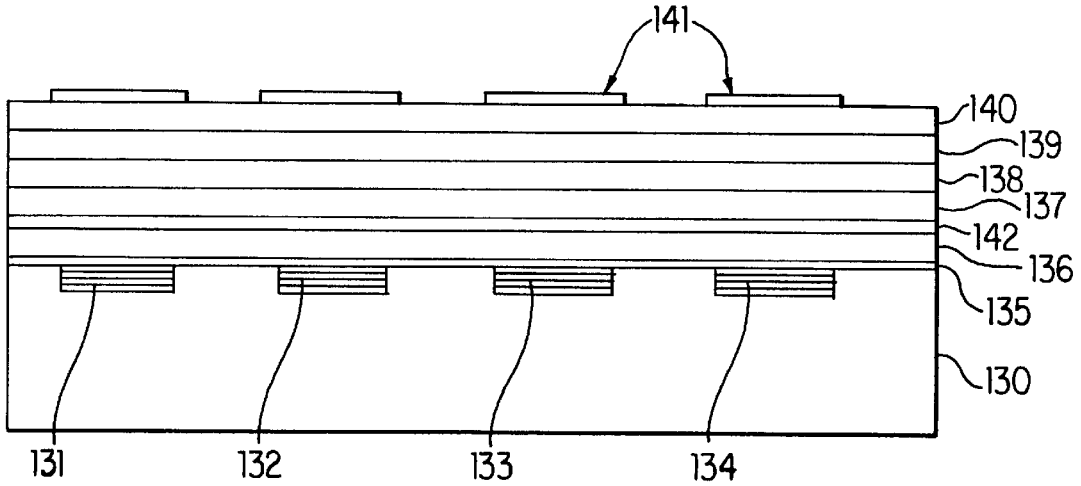
FIG. 4 is a schematic diagram of a multi-layer electroluminescent device used for a multicolor printbar according to another embodiment of the present invention.

Following the procedure described in J. Kido, et. al., "Multilayer White Light-Emitting Organic Electroluminescent Device," *Science*, Vol. 267, pp. 1332–1334 (1995), a multi-layer electroluminescent device is produced. The structure of the electroluminescent device is shown schematically in FIG. 4. As shown in FIG. 4, the device includes a glass substrate 130, reflectors 131, 132, 133, and 134, an indium tin oxide contact layer 135, a hole transporting layer 136, an electron transporting/hole blocking layer 142, four electron transporting layers 137, 138, 139 and 140, and magnesium:silver contacts 141.

In the electroluminescent device of this Example, the hole transporting layer 136 is formed of a triphenyldiamine derivative; the electron transporting/hole blocking layer 142 is formed of a 1,2,4-triazole derivative; and the first through fourth electron transporting layers are formed of tris (8quinolinolato)aluminum(III). The first and fourth electron transporting layers (137 and 140, respectively) are undoped with dye; the second electron transporting layer (138) is doped with a red dye; and the third electron transporting layer (139) is doped with an infrared dye. The reflectors 131, 132, 133 and 134 are produced to reflect infrared, red, green and blue light wavelengths, respectively. The dyes used in this Example 2 are the same as an Example 1. In addition, the electroluminescent device is prepared following the same procedures as Example 1, above.

Example 3

Reference is now made to FIG. 1, wherein there is illustrated an electrostatographic printing system 5 according to one embodiment of the present invention. The depicted embodiment utilizes a charge retentive member in the form of a photoconductive belt 10 including a four-layer photoconductive surface and an electrically conductive substrate, and mounted for successive movement past a charging station A, an exposure station B, a first development station C, a second development station D, a first uniform exposure station E, a third development station F, a second uniform exposure station G, a fourth development station H, a pre-transfer charging station I, a transfer station J, a fusing station K and a cleaning station L. Photoconductive belt 10 moves in the direction of arrow 12 to advance successive portions of the belt sequentially through the various processing stations disposed about the path of movement thereof for forming images in a single pass of the belt through all of the process stations. Photoconductive belt 10 is entrained about a plurality of rollers 14, 16 and 18. In this FIG. 1, roller 14 is used as a drive roller and rollers 16 and 18 are used to provide suitable tensioning of the photoreceptor belt 10. Motor 20 rotates roller 14 to advance the belt 10 in the direction of arrow 12. Roller 14 is coupled to motor 20 by suitable means such as a belt drive.

As can be seen in FIG. 1, initially successive portions of photoconductive belt 10 pass through charging station A, where a corona discharge device such as a scorotron, corotron, or dicorotron, indicated generally by the reference numeral 22, charges the photoconductive belt 10 to a selectively high uniform positive or negative potential, $V_O$. Any suitable control circuit, as well known in the art, may be employed for controlling the corona discharge device 22.

Next, the charged portions of the photoreceptor surface are advanced through exposure station B. At exposure station B, the uniformly charged photoreceptor or charge retentive surface 10 is exposed to a multicolor printbar 42, such as the multicolor printbar of Example 1 above, emitting four different wavelength light beams 40, which causes the charge retentive surface to remain charged or to be discharged in accordance with the output from the multicolor printbar. An electronic subsystem (not shown) converts a previously stored image into the appropriate control signals for the multicolor printbar 42 in an imagewise fashion.

The multicolor printbar 42 emits an array of four different wavelength light beams in imagewise fashion, designated generally as light beams 40, at about 450, 550, 655, and 725 nanometers, respectively, in the blue, green, red and infrared wavelengths. Each light emitting area of the printbar is independently modulated to form the light beams 40 to expose the associated photoreceptor layer in accordance with a respective color image. As stated earlier, at exposure station B, the uniformly charged photoreceptor or charge retentive surface 10 is exposed to the multicolor printbar 42, which causes the charge retentive surface to remain charged or to be discharged in accordance with the output from the printbar.

As shown in FIG. 1, at the first development station C, a charged area development (CAD) system, indicated generally by the reference numeral 64, advances developer materials into contact with the electrostatic latent images. The development system 64 comprises a developer housing 64 that contains a pair of magnetic brush rollers 66 and 68. The rollers advance developer material into contact with the photoreceptor for developing the regions above the bias potential. The developer material, by way of example, contains positively charged black toner. The black toner is applied to the latent electrostatic images contained on the photoconductive surface 10 via magnetic brush rollers, the carrier of this two component developer being selected such that the black toner is positively charged through triboelectric charging thereagainst. Electrical biasing is accomplished via a power supply (not shown), electrically connected to the developer apparatus. A suitable DC bias voltage is applied to the rollers 66 and 68 via the power supply.

At second development station D, a discharged area development (DAD) system, indicated generally by the reference numeral 70, advances developer materials into contact with the DAD electrostatic latent images. The development system 70 comprises a first developer housing 70 containing a pair of magnetic brush rollers 72 and 74. The rollers advance developer material into contact with the photoreceptor for developing the regions below the bias potential. The developer material, by way of example, contains negatively charged cyan toner. The cyan toner is applied to the latent electrostatic images contained on the photoconductive surface 10 via magnetic brush rollers, the carrier of this two component developer being selected such that the cyan toner is negatively charged through triboelectric charging thereagainst. Electrical biasing is accomplished via a power supply (not shown), electrically connected to the developer apparatus. A suitable DC bias voltage is applied to the rollers 72 and 74 via the power supply.

Next, a non-imaging uniform exposure of green light is applied to the photoconductor 10 with a well controlled light source such as a fluorescent lamp 76 at the first uniform exposure station E. Those areas previously imaged with green light survive the blanket green light exposure and all subsequent development steps to become the white areas of the image. The areas of the photoreceptor that have already been developed with black toner are shielded from the green light by the deposited toner. Accordingly, little or no discharge occurs in these areas. If necessary, the emission spectrum of the lamp could be tuned relative to the absorption spectra of the toners to fully insure that discharge beneath the toners does not take place.

At third development station F, a DAD development system, indicated generally by the reference numeral 78, advances developer materials into contact with the electrostatic latent images. The developer housing 78 contains a pair of magnetic rolls 80 and 82. The rollers advance developer material into contact with the photoreceptor 10 for developing the regions below the bias potential. The developer material, by way of example, contains negatively charged magenta toner. Appropriate electrical biasing is accomplished via a power supply (not shown) electrically connected to the developer apparatus. A suitable DC bias is applied to the rollers 80 and 82 via the bias power supply.

Next, a non-imaging uniform exposure of blue light is applied to the photoconductor 10 with a well controlled light source, such as a fluorescent lamp 84 at the second uniform exposure station G. The areas of the photoreceptor 10 that have already been developed with black toner are shielded from the blue light by the deposited toner. Accordingly, little or no discharge occurs in these areas. If necessary, the emission spectrum of the lamp could be tuned relative to the absorption spectra of the toners to fully insure that discharge beneath the toners does not take place.

At fourth development station H, a DAD development system, indicated generally by the reference numeral 86, advances developer materials into contact with the electrostatic latent images. The developer housing 86 contains a pair of magnetic rollers 88 and 90. The rollers advance developer material into contact with the photoreceptor 10 for developing the regions below the bias potential. The developer material, by way of example, contains negatively charged yellow toner. Appropriate electrical biasing is accomplished via a power supply (not shown) electrically connected to developer apparatus. A suitable DC bias is applied to the rollers 88 and 90 via the bias power supply.

Because the composite image developed on the photoreceptor consists of both positive and negative toner, a typically positive pre-transfer corona discharge member 92, disposed at pre-transfer charging station I, is provided to condition the toner for effective transfer to a substrate using positive corona discharge. The pre-transfer corona discharge member is preferably an AC corona device biased with a DC voltage to operate in a field sensitive mode and to perform electrostatic pre-transfer charging in a way that selectively adds more charge (or at least comparable charge) to the parts of the image that must have their polarity reversed. This charge discrimination may be enhanced by discharging the photoreceptor 10 carrying the composite developed latent image with light before the pre-transfer charging begins. Furthermore, flooding the photoreceptor with light coincident with the pre-transfer charging minimizes the tendency to overcharge portions of the image which are already at the correct polarity.

A sheet of support material 94 is moved into contact with the toner image at transfer station J. The sheet of support material 94 is advanced to transfer station J by a conventional sheet feeding apparatus, not shown. Preferably, the sheet feeding apparatus includes a feed roll contacting the uppermost sheet of a stack of copy sheets. The feed rolls rotate to advance the uppermost sheet from the stack into a chute, which directs the advancing sheet of support material 94 into contact with photoconductive surface of belt 10 in a timed sequence, so that the developed toner powder image contacts the advancing sheet of support material at transfer station J.

Transfer station J includes a corona generating device 96 that sprays ions of a suitable polarity onto the backside of sheet 94. This attracts the charged toner powder images from the belt 10 to the sheet 94. After transfer, the sheet 94 continues to move, in the direction of arrow 98, onto a conveyor (not shown), which advances the sheet to fusing station K.

Fusing station K includes a fuser assembly, indicated generally by the reference numeral 100, which permanently affixes the transferred powder image to sheet 94. Preferably, fuser assembly 100 comprises a heated fuser roller 102 and a backup roller 104. Sheet 94 passes between fuser roller 102 and backup roller 104 with the toner powder image contacting fuser roller 102. In this manner, the toner powder image is permanently affixed to sheet 94. After fusing, a chute (not shown) guides the advancing sheet 94 to a catch tray (also not shown) for subsequent removal from the printing machine by the operator.

After the sheet of support material 94 is separated from the photoconductive surface of the belt 10, the residual toner particles carried on the photoconductive surface are removed therefrom at cleaning station L. A magnetic brush cleaner housing is disposed at the cleaner station L. The cleaner apparatus comprises a conventional magnetic brush roller structure for causing carrier particles in the cleaner housing to form a brush-like orientation relative to the roller structure and the charge retentive surface. It also includes a pair of detoning rollers for removing the residual toner from the brush.

Subsequent to cleaning, a discharge lamp (not shown) floods the photoconductive surface with light to dissipate any residual electrostatic charge remaining prior to the charging thereof for the successive imaging cycle.

What is claimed is:

1. A multicolor light emitting array, comprising a plurality of discrete light emitting areas, wherein each discrete light emitting area emits light having a color determined by at least one discrete color-selective multilayer reflector, wherein said light emitting areas are one of electroluminescent devices, light emitting diodes, or vertical cavity surface emitting lasers.

2. The multicolor array according to claim 1, wherein said color-selective multilayer reflector is in a discrete Fabry-Perot cavity resonant at said color.

3. The multicolor array according to claim 1, wherein said light emitting areas are electroluminescent devices comprising a substrate layer, a single light emitting layer, and a metal contact, wherein said light emitting layer emits light with a plurality of wavelengths.

4. The multicolor array according to claim 3, wherein said light emitting layer is doped with four dyes.

5. The multicolor array according to claim 1, wherein said light emitting areas are electroluminescent devices comprising a substrate layer, a plurality of light emitting layers, and a metal contact, wherein each of said plurality of light emitting layers emits light of a different wavelength.

6. The multicolor array according to claim 5, wherein said each of said plurality of discrete emitting layers is doped with a different dye.

7. The multicolor array according to claim 1, comprising a plurality of said discrete color-selective multilayer reflectors.

8. The multicolor array according to claim 7, wherein a set of said plurality of said discrete color-selective multilayer reflectors has a high pass characteristic, whereby only light with the shortest wavelength is reflected.

9. The multicolor array according to claim 7, wherein a set of said plurality of said discrete color-selective multilayer reflectors has a low pass characteristic, whereby only light with the longest wavelength is reflected.

10. The multicolor array according to claim 1, comprising a plurality of subarrays, each subarray emitting light of a different wavelength.

11. The multicolor array according to claim 10, wherein said subarrays are linear subarrays arranged perpendicular to a length of said multicolor array.

12. The multicolor array according to claim 10, wherein said light emitting areas in said plurality of subarrays are arranged such that they are linearly aligned in a direction perpendicular to a length of said multicolor array.

13. An electrostatographic development system comprising:

a multicolor light emitting array according to claim 1, emitting light of multiple wavelengths, a photoreceptor means for receiving said emitted light and for holding a toner image, having a plurality of layers, each layer being sensitive or accessible only to one of said multiple wavelengths, and electrostatographic development means for exposing areas of said photoreceptor means to emitted light from said multicolor array, and, after exposure, said development means depositing at least a plurality of toners on said photoreceptor means in response to exposure of said areas of said layers to said emitted light.

14. The electrostatographic development system of claim 13, wherein said multicolor light emitting array emits light of at least four different wavelengths and said photoreceptor means comprises four layers, each layer being sensitive or accessible only to one of said at least four different wavelengths.

15. The multicolor light emitting array according to claim 1, wherein said light emitting areas are electroluminescent devices.

16. The multicolor light emitting array according to claim 1, wherein said light emitting areas are light emitting diodes.

17. The multicolor light emitting array according to claim 1, wherein said light emitting areas are vertical cavity surface emitting lasers.

18. The multicolor array according to claim 1, wherein said at least one discrete color-selective multilayer reflector is patterned directly on a substrate and said light emitting areas are formed over said at least one discrete color-selective multilayer reflector.

19. A multicolor light emitting array, comprising a plurality of subarrays, wherein each subarray comprises a plurality of discrete light emitting areas having a color determined by at least one discrete color-selective multilayer reflector, with light emitting areas in the same subarray emitting light of substantially a same color and different subarrays emitting different colors.

20. The multicolor array according to claim 19, wherein said subarrays are linear subarrays arranged perpendicular to a length of said multicolor array.

21. The multicolor array according to claim 19, wherein said light emitting areas in said plurality of subarrays are arranged such that they are linearly aligned in a direction perpendicular to a length of said multicolor array.

* * * * *